US010446076B2

(12) United States Patent
Wu

(10) Patent No.: US 10,446,076 B2
(45) Date of Patent: Oct. 15, 2019

(54) DISPLAY DEVICE

(71) Applicant: Japan Display Inc., Tokyo (JP)

(72) Inventor: Ilin Wu, Tokyo (JP)

(73) Assignee: Japan Display Inc., Tokyo (JP)

( * ) Notice: Subject to any disclaimer, the term of this patent is extended or adjusted under 35 U.S.C. 154(b) by 308 days.

(21) Appl. No.: 15/367,599

(22) Filed: Dec. 2, 2016

(65) Prior Publication Data

US 2017/0178568 A1 Jun. 22, 2017

(30) Foreign Application Priority Data

Dec. 21, 2015 (JP) ..... 2015-248554

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3233; G09G 3/3291; G09G 3/3266; G09G 2300/0842;
(Continued)

(56) References Cited

U.S. PATENT DOCUMENTS

2008/0143653 A1* 6/2008 Shishido ..... G09G 3/3233 345/78
2014/0168195 A1 6/2014 Kumeta et al.
(Continued)

FOREIGN PATENT DOCUMENTS

CN 101206832 A 6/2008
CN 103474024 A 12/2013
(Continued)

OTHER PUBLICATIONS

Chinese Office Action dated Aug. 22, 2018 for the corresponding Chinese Patent Application No. 201611150191.5 with partial English translation.
(Continued)

*Primary Examiner* — Amr A Awad
*Assistant Examiner* — Maheen I Javed
(74) *Attorney, Agent, or Firm* — Michael Best & Friedrich LLP

(57) ABSTRACT

A display device related to one embodiment of the present invention includes a plurality of pixel circuits each connected to a scanning signal line, initialization control signal line, light emitting control signal line and video signal line, wherein each of the plurality of pixel circuits includes a first transistor connected to the scanning signal line and the video signal line, a second transistor connected to a first node and the first transistor, a third transistor connected to the first node and a scanning signal line, a fourth transistor connected to the second transistor and the light emitting control signal line, and a fifth transistor connected to the second transistor, a power supply voltage line, and the light emitting control signal line.

7 Claims, 14 Drawing Sheets

(52) U.S. Cl.
CPC ..... *G09G 2300/0814* (2013.01); *G09G 2300/0819* (2013.01); *G09G 2300/0842* (2013.01); *G09G 2300/0861* (2013.01); *G09G 2310/0245* (2013.01); *G09G 2310/0251* (2013.01); *G09G 2310/08* (2013.01); *G09G 2320/0271* (2013.01)

(58) Field of Classification Search
CPC ... G09G 2300/0814; G09G 2310/0245; G09G 2310/0251; G09G 2300/0819; G09G 2310/08; G09G 2300/0861; G09G 2320/0271
See application file for complete search history.

(56) References Cited

U.S. PATENT DOCUMENTS

| | | | | |
|---|---|---|---|---|
| 2015/0062195 | A1 | 3/2015 | Kumeta et al. | |
| 2015/0339976 | A1* | 11/2015 | Tsai ..... | G09G 3/3233 315/172 |
| 2016/0125808 | A1 | 5/2016 | Hsu et al. | |
| 2016/0155383 | A1 | 6/2016 | Chen | |

FOREIGN PATENT DOCUMENTS

| | | | |
|---|---|---|---|
| CN | 104157244 | A | 11/2014 |
| CN | 104464635 | A | 3/2015 |
| JP | 2008-151963 | A | 7/2008 |
| JP | 2014-119574 | A | 6/2014 |
| JP | 2015-049335 | A | 3/2015 |

OTHER PUBLICATIONS

Taiwanese Office Action dated Sep. 29, 2017 for the corresponding Taiwanese application No. 105136214.
Chinese Office Action dated Mar. 1, 2019 for the corresponding Chinese application No. 201611150191.5, with partial English translation.
Japanese Office Action dated Jul. 16, 2019 for the corresponding Japanese application No. 2015-248554, with partial English machine translation.
Chinese Office Action dated Aug. 13, 2019 for the corresponding Chinese application No. 201611150191.5, with partial English translation.

* cited by examiner

DISPLAY DEVICE

CROSS-REFERENCE TO RELATED APPLICATIONS

This application is based upon and claims the benefit of priority from the prior Japanese Patent Application No. 2015-248554, filed on Dec. 21, 2015, the entire contents of which are incorporated herein by reference.

FIELD

The present invention is related to a display device. In particular, the present invention is related to a display device in which a light emitting element arranged in a pixel is current driven.

BACKGROUND

An organic electroluminescence (to be referred to as organic EL hereinafter) display device includes a light emitting element corresponding to each pixel and displays an image by individually controlling the emitted light. A light emitting element includes an anode electrode, cathode electrode and a layer (to be also referred to as a [light emitting layer] hereinafter) which includes and an organic EL material sandwiched between this pair of electrodes. In an organic EL display device, one of the anode electrode or cathode electrode is arranged as a pixel electrode for each pixel and the other is arranged as a common electrode. A common electrode is also referred to as a common voltage line which is applied with a common voltage across a plurality of pixels. An organic EL display device controls the light emitted by a pixel by applying a voltage of a pixel electrode to each pixel with respect to a voltage of the common electrode.

A drive transistor is connected to a light emitting element arranged in each pixel of a display device. When there is a variation in a threshold voltage of a plurality of drive transistor, this is reflected in the luminosity of a display device which sometimes produces display defects. In order to compensate for display defects due to variation in a threshold voltage of a drive transistor, a display device and a driving method of the display device are disclosed in Japanese Laid Open Patent Publication No. 2015-049335 for example which perform threshold compensation of a drive transistor.

However, in the conventional technology, at least six transistors are required with respect to one pixel in order to compensate for threshold voltage of a drive transistor. A circuit with a reduced number of transistors per pixel is also being demanded due to further high definition of a display device.

SUMMARY

One aspect of a display device according to the present invention includes a plurality of scanning signal lines; a plurality of initialization control signal lines; a plurality of light emitting control signal lines; a plurality of video signal lines arranged intersecting the scanning signal line, the initialization control signal line and the light emitting control signal line; and a plurality of pixel circuits each connected to the scanning signal line, the initialization control signal line, the light emitting control signal line and the video signal line; wherein each of the plurality of pixel circuits includes a first transistor including a control terminal connected to the scanning signal line, a first terminal connected to the video signal line, and a second terminal; a second transistor including a control terminal connected to a first node, a first terminal connected to the second terminal of the first transistor, and a second terminal; a third transistor including a first terminal connected to the first node, a second terminal connected to the second terminal of the second transistor, and a control terminal connected to the scanning signal line; a fourth transistor including a first terminal connected to the second terminal of the second transistor, a second terminal, and a control terminal connected to the light emitting control signal line; a fifth transistor including a first terminal connected to the first terminal of the second transistor, a second terminal connected to a power supply voltage line, and a control terminal connected to the light emitting control signal line; a storage capacitor including a first terminal connected to the first node, and a second terminal connected to the initialization control signal line; and a light emitting element connected to the second terminal of the fourth transistor.

One aspect of a display device according to the present invention includes a plurality of first scanning signal lines; a plurality of second scanning signal lines; a plurality of initialization control signal lines; a plurality of light emitting control signal lines; a plurality of video signal lines arranged intersecting the first scanning signal line, the second scanning signal line, the initialization control signal line and the light emitting control signal line; and a plurality of pixel circuit groups each connected to the first scanning signal line, the second scanning signal line, the initialization control signal line, the light emitting control signal line and the video signal line; wherein each of the plurality of pixel circuit groups includes a plurality of pixel circuits a first transistor including a control terminal connected to the light emitting control signal line, a first terminal connected to a power supply voltage line, and a second terminal; and a fifth transistor including a control terminal connected to the first scanning signal line, a first terminal connected to the video signal line, and a second terminal; each of the plurality of pixel circuits includes a second transistor including a control terminal connected to a first node, a first terminal connected to the second terminal of the first transistor and the second terminal of the fifth transistor, and a second terminal; a third transistor including a first terminal connected to the first node, a second terminal connected to the second terminal of the second transistor, and a control terminal connected to the second scanning signal line; a fourth transistor including a first terminal connected to the second terminal of the second transistor, a second terminal, and a control terminal connected to the light emitting control signal line; a storage capacitor including a first terminal connected to the first node, and a second terminal connected to the initialization control signal line; and a light emitting element connected to the second terminal of the fourth transistor.

DESCRIPTION OF EMBODIMENTS

The embodiments of the present invention are explained below while referring to the diagrams. However, it is possible to perform the present invention using various different forms, and the present invention should not be limited to the content described in the embodiments exemplified herein. Although the width, thickness and shape of each component are shown schematically compared to their actual form in order to better clarify explanation, the drawings are merely an example and should not limit an interpretation of the present invention. In addition, in the specification and each drawing, the same reference symbols are attached to similar elements and elements that have been mentioned in previous drawings, and therefore a detailed explanation may be omitted where appropriate.

First Embodiment

A display device 100 and driving method of the display device related to the present embodiment are explained using the drawings.

[Schematic Structure]

Figure 1:
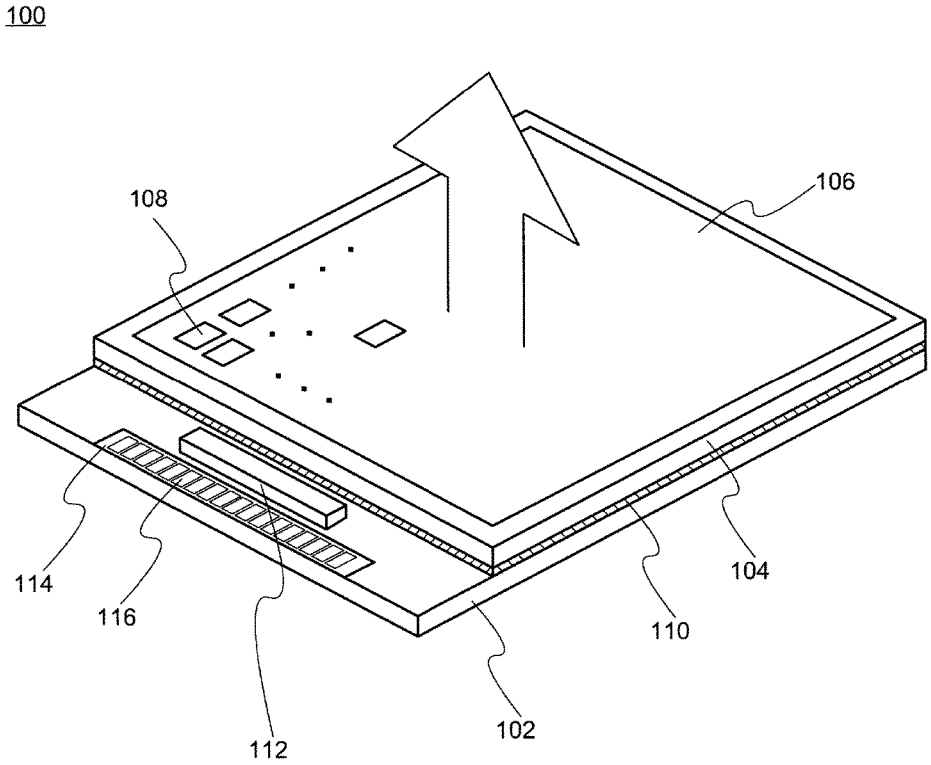
FIG. 1 is a perspective view diagram for explaining a schematic structure of a display device related to one embodiment of the present invention.

FIG. 1 is a perspective view diagram for explaining a schematic structure of a display device 100 related to the present embodiment. The display device 100 related to the present embodiment includes a first substrate 102, second substrate 104, a plurality of pixels 108, a sealing member 110, a terminal region 114 and a connection terminal 116.

A display region 106 is arranged above the first substrate 102. The plurality of pixels 108 including at least one light emitting element are each arranged in the display region 106.

The second substrate 104 is arranged opposing the first substrate 102 on an upper surface of the display region 106. The second substrate 104 is fixed to the first substrate 102 by the sealing member 110 which encloses the display region 106. The display region 106 formed in the first substrate 102 is sealed by the second substrate 104 and sealing member 110 so as not to be exposed to air. Degradation of a light emitting element arranged in a pixel 108 is suppressed by such a sealing structure.

A terminal region 114 is arranged at one end part of the first substrate 102. The terminal region 114 is arranged on the outer side of the second substrate 104. The terminal region 114 is the area including a plurality of connection terminals 116. A wiring substrate which connects devices which output a video signal or external devices such as a power supply with a display panel (display device 100 in FIG. 1) is arranged in the connection terminal 116. A connection point of the connection terminal 116 with a wiring substrate is exposed to the exterior. A driver IC 112 which outputs a video signal input from the connection terminal 116 to the display region 106 is arranged in the first substrate 102.

[Circuit Structure]

Figure 2:
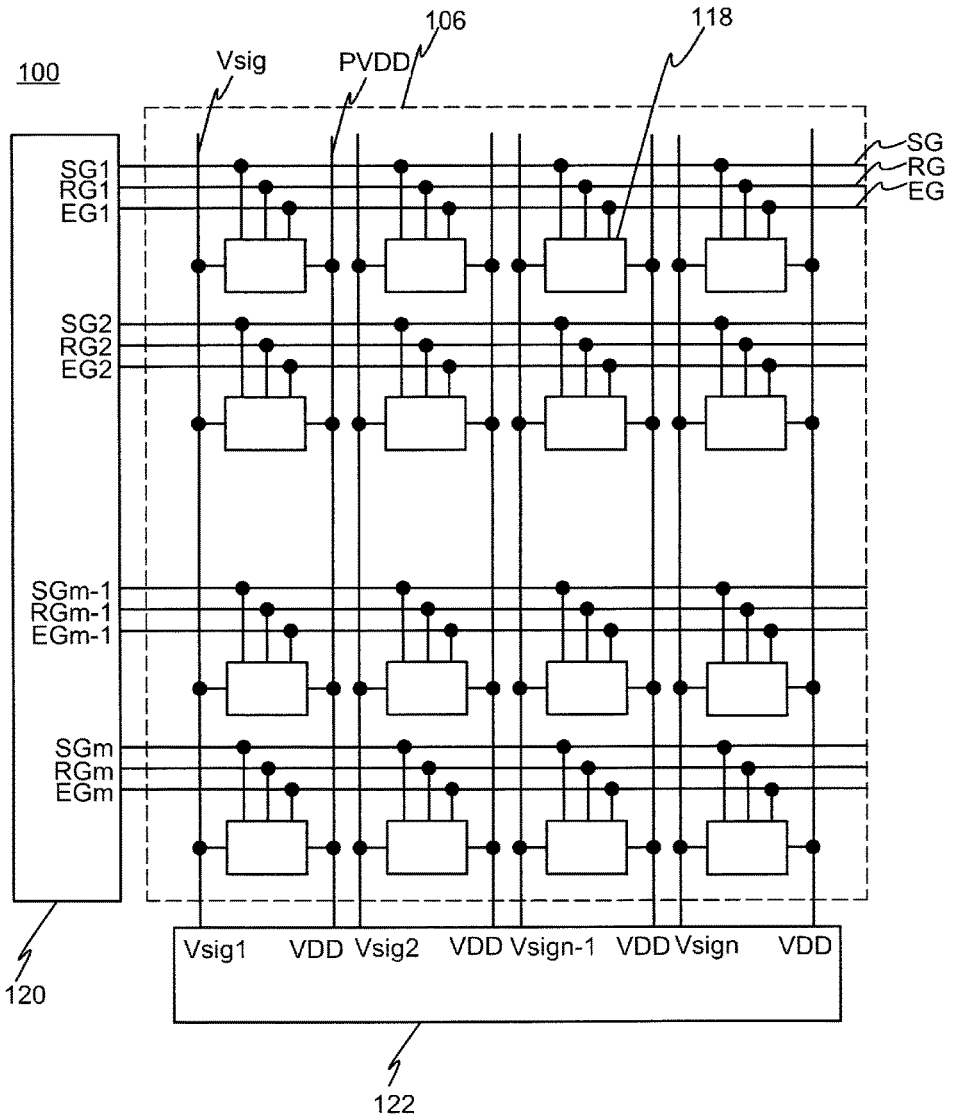
FIG. 2 is a diagram for explaining a circuit structure of a display device related to one embodiment of the present invention.

FIG. 2 is a circuit diagram for explaining a circuit structure of the display device 100 related to the present embodiment.

The display device 100 related to the present embodiment includes a plurality of pixel circuits 118, a scanning line drive circuit 120, and a signal line drive circuit 122. The display device 100 further includes a plurality of scanning signal lines SG, a plurality of initialization control signal lines RG, a plurality of light emitting control signal lines EG, a plurality of video signal lines Vsig and a plurality of power supply voltage lines PVDD. Furthermore, the display device 100 also includes a common voltage line PVSS which is not shown in FIG. 2.

A scanning line drive circuit 120 outputs signals SG1~SGm to each of the plurality of scanning signal lines SG respectively, outputs signals RG1~RGm to each of the plurality of initialization controls signal lines RG respectively, and outputs signals EG1~EGm to each of the plurality of light emitting control signal lines EG respectively.

A signal line drive circuit 122 outputs video signals Vsig1~Vsign to each of the plurality of video signal lines Vsig respectively. In addition, as is shown in the diagrams, the signal line drive circuit 122 may also output a power supply voltage VDD to the plurality of power supply voltage lines PVDD. The plurality of video signal lines Vsig and the plurality of power supply voltage lines PVDD are arranged intersecting the plurality of scanning signal lines SG, the plurality of initialization control signal lines RG and the plurality of light emitting control signal lines EG.

The plurality of pixel circuits 118 is arranged in a matrix shape in the display region 106 of the display device 100. Each of the plurality of pixel circuits 118 is connected to any one of the plurality of scanning signal lines SG and any one of the plurality of video signal lines Vsig. Furthermore, each of the plurality of pixel circuits 118 is connected to any one of the plurality of initialization control signal lines RG, any one of the plurality of light emitting control signal lines EG and any one of the plurality of power supply voltage lines PVDD. Although the arrangement of the plurality of pixel circuits 118 is not limited to a matrix shape, in the present embodiment the arrangement of the plurality of pixel circuits 118 is explained as being arranged in m rows and n columns (m and n are integers) in a matrix shape.

Next, a circuit structure of each of the plurality of pixel circuits 118 in the display device 100 related to the present embodiment is explained in detail.

Each of the pixel circuits 118 includes a plurality of transistors. In the explanation below, a terminal of a transistor is sometimes referred to as a [control terminal]. In addition, for the purposes of convenience, one of either a source terminal or a drain terminal of a transistor is sometimes referred to as a [first terminal] and the other is sometimes referred to as a [second terminal]. That is, a first terminal of a transistor may sometimes function as a source terminal and may sometimes function as a drain terminal depending on the conditions of a voltage applied to each terminal of the transistor. The same is also the case with respect to the second terminal.

Figure 3:
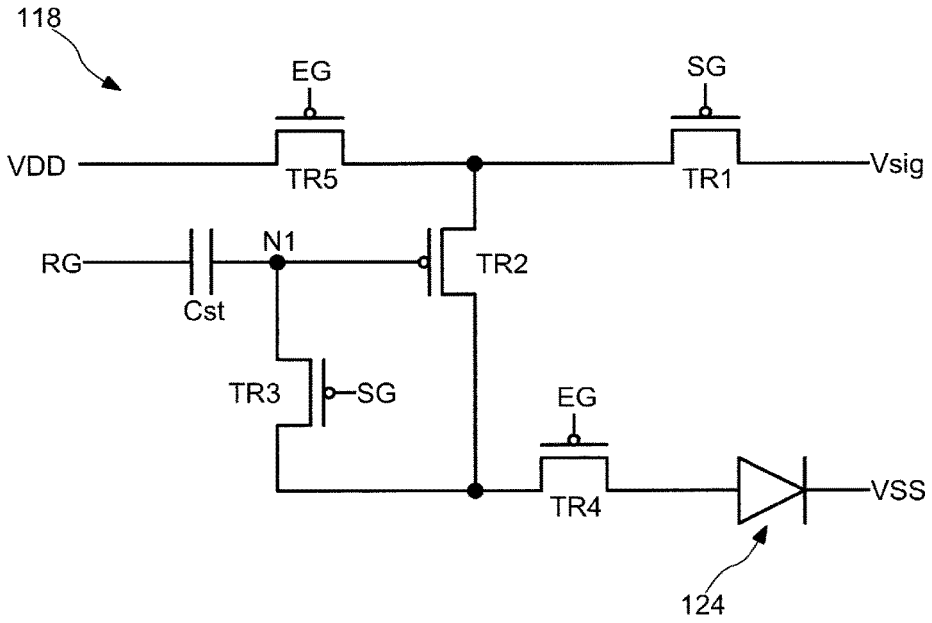
FIG. 3 is a circuit diagram of pixel circuit related to one embodiment of the present invention.

FIG. 3 is a diagram for explaining a circuit structure of each of the plurality of pixel circuits 118 included in the display device 100 related to the present embodiment. Each of the plurality of pixel circuits 118 included in the display device 100 related to the present embodiment includes first to fifth transistors TR1~TR5, a storage capacitor Cst and a light emitting element 124.

A control terminal of the first transistor TR1 is connected to a scanning signal line SG. In addition, a first terminal of the first transistor TR1 is connected to a video signal line Vsig. That is, the first transistor TR1 functions as a selection transistor.

A control terminal of the second transistor TR2 is connected to a first node N1. In addition, a first terminal of the second transistor TR2 is connected to a second terminal of the first transistor TR1. The second transistor TR2 functions as a drive transistor and supplies a current to the light emitting element 124 depending on a voltage applied to a control terminal. In addition, when driving the display device 100, the second transistor TR2 drives in a saturated state.

A control terminal of the third transistor TR3 is connected to a scanning signal line SG. In addition, a first terminal of the third transistor TR3 is connected to a first node N1. A second terminal of the third transistor TR3 is connected to the second terminal of the second transistor TR2. When the third transistor TR3 is turned ON according to a voltage output to a scanning signal line SG, a control terminal and second terminal conduct electricity and the second transistor TR2 changes to a diode connected state.

A control terminal of the fourth transistor TR4 is connected to a light emitting control signal line EG. In addition, a first terminal of the fourth transistor TR4 is connected to the second terminal of the second transistor TR2 and the second terminal of the third transistor TR3.

A control terminal of the fifth transistor TR5 is connected to a light emitting control signal line EG. In addition, a first terminal of the fifth transistor TR5 is connected to the first terminal of the second transistor TR2. A second terminal of the fifth transistor TR5 is connected to a power supply voltage line PVDD. By controlling a voltage of the light emitting control signal line EG and turning both the fourth transistor TR4 and fifth transistor TR5 to ON, it is possible to supply a current to a light emitting element 124 and set the light emitting element 124 to a light emitting state.

A first terminal of the storage capacitor Cst is connected to a first node N1. A second terminal of the storage capacitor Cst is connected to an initialization control signal line RG.

An anode of the light emitting element 124 is connected to the second terminal of the fourth transistor TR4. A cathode of the light emitting element 124 is connected to a common voltage line PVSS. The light emitting element 124 is a current driven type element which emits light at the luminosity according to a supplied current. In the present embodiment, the light emitting element 124 is an organic light emitting diode.

Furthermore, in the present embodiment, the first to fifth transistors TR1~TR5 are P channel transistors. However, the present invention is not limited to this, and any one or all of the first to fifth transistors TR1~TR5 may be N channel transistors. That is, first to sixth transistors TR1, TR2A~TR5A, TR6 may be P channel transistors having the same polarity. Furthermore, since the relationship between a source and drain is interchanged in the case where all of the transistors are N channel transistors, the connection relationship of a circuit may be appropriately changed.

The structure of a pixel circuit included in the display device 100 related to the present embodiment was explained above. In the present embodiment, a circuit structure is adopted including five transistors and one capacitor per pixel. In the conventional technology, at least six transistors were necessary with respect to one pixel in order to compensate a threshold voltage of a drive transistor.

According to a driving method of the display device 100 described in detail herein, it is possible to perform threshold compensation in the display device 100 having the structure described above. That is, since it is possible to reduce the number of transistors included in one pixel using the display device 100 compared to a display device of the conventional technology, further high definition of the display device 100 is possible.

[Driving Method]

A driving method of the display device 100 related to the present embodiment is explained using the drawings.

Figure 4:
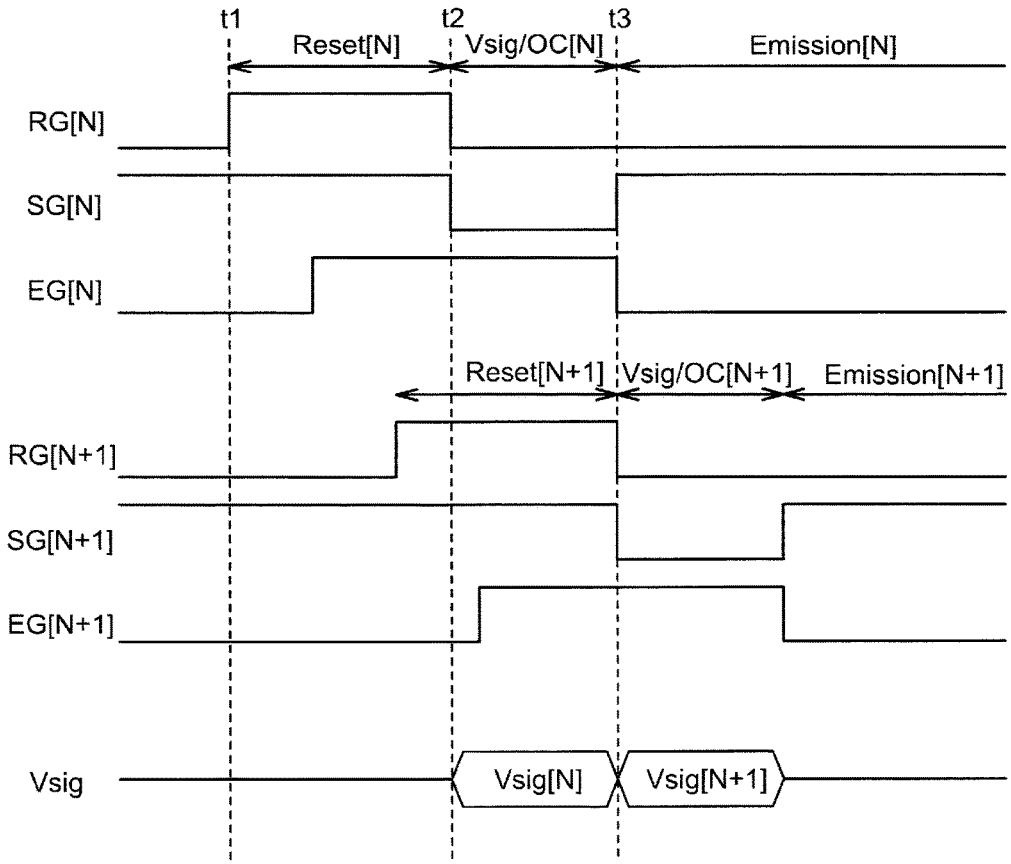
FIG. 4 is a timing chart for explaining a driving method of a display device related to one embodiment of the present invention.

FIG. 4 is a timing chart for explaining a driving method of the display device 100 related to the present embodiment. In FIG. 4, among the pixel circuits 118 arranged in a matrix, a timing chart is shown of a pixel circuit 118 arranged on an nth row (sometimes shown as pixel circuit 118*a* below), and a pixel circuit 118 arranged on an n+1 row (sometimes shown as pixel circuit 118*b* below). The pixel circuit 118*a* and pixel circuit 118*b* are arranged on the same column.

The display device 100 related to the present embodiment is driven in one frame including three periods, an initialization period, a writing and threshold compensation period, and a light emitting period.

Figure 5:
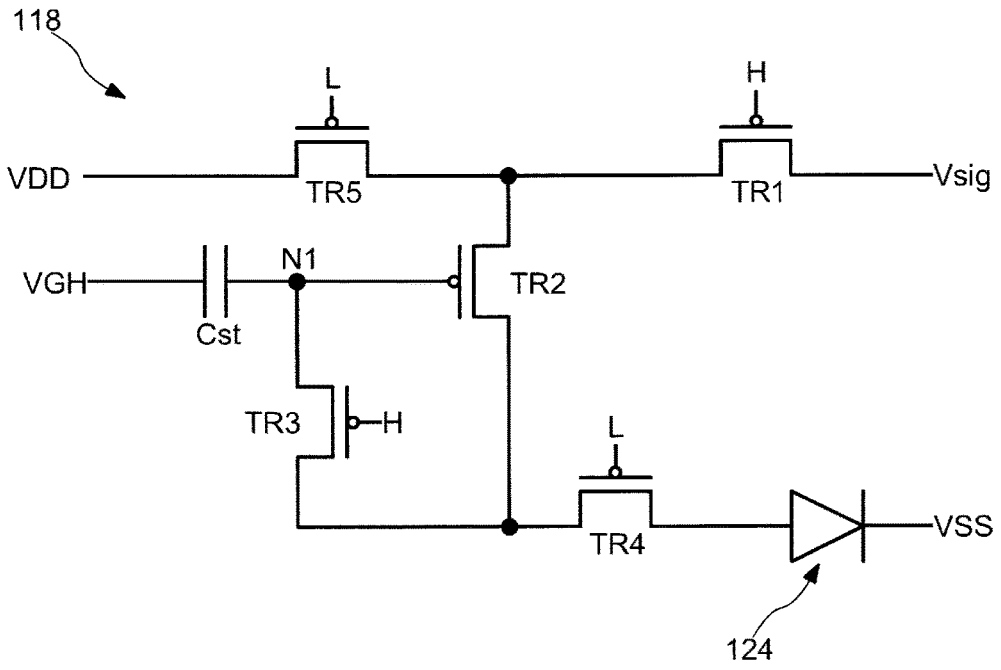
FIG. 5 is a circuit diagram for explaining an operation in an initialization period of a display device related to one embodiment of the present invention.

First, driving in an initialization period is explained. The period between time t1 and time t2 is the initialization period (Reset [N]) of a pixel circuit 118*a*. FIG. 5 is a circuit diagram for explaining the operation of an initialization period of the display device 100 related to the present embodiment.

Immediately before an initialization period, since a charge corresponding to gradation data of a previous frame is accumulated in the first node N1, a certain voltage is initialized by discharging this charge in the initialization period before writing gradation data of the subsequent frame.

Before entering an initialization period, a signal for turning the third transistor TR3 to OFF is supplied in advance to the control terminal of the third transistor TR3. In the present embodiment, since the third transistor TR3 is a P channel transistor, a high level (H) voltage is applied to the control terminal of the third transistor TR3 and turned OFF in advance.

In addition, at the latest, before entering an initialization period, a signal for turning the fourth transistor TR4 and fifth transistor TR5 to ON is supplied in advance to a light emitting control signal line EG. In the present embodiment, since the fourth transistor TR4 and fifth transistor TR5 are P channel transistors, a low level (L) voltage is applied to the control terminal of the fourth transistor TR4 and fifth transistor TR5 via the light emitting control signal line EG and turned ON in advance.

When entering the initialization period at time t1 in this state, a voltage of the second terminal of the storage capacitor Cst is changed by changing an initialization control signal line RG to a first voltage V1 so that the third transistor TR3 is turned ON. In the present embodiment, since the third transistor TR3 is a P channel transistor, a positive voltage VGH is applied to the second terminal of the storage capacitor Cst via the initialization control signal line RG and the third transistor TR3 is turned ON.

In order to turn the third transistor TR3 to ON, it is necessary to supply a higher voltage than a voltage VG3+Vth3 obtained by adding a threshold voltage Vth3 of the third transistor TR3 to a high level voltage VG3 supplied to a control terminal of the third transistor TR3 to a first terminal (first node N1) of the third transistor TR3. In this way, the third transistor TR3 is turned ON since the voltage of the control terminal of the third transistor TR3 drops lower than Vth3 when the first terminal of the third transistor TR3 is set as a reference.

In this way, it is possible to discharge a charge accumulated in the first node N1 in a previous frame via the third transistor TR3. At this time, the second transistor TR2 is maintained in an OFF state.

A charge accumulated in the first node N1 in a previous frame is discharged by the operation in the initialization period. At this time, this charge is discharged to a common voltage line PVSS via the light emitting element 124. A video signal written in a previous frame from the storage capacitor Cst is initialized by this discharge. Specifically, the voltage of the first node N1 is a voltage which does not include a video signal of a previous frame, and converges to a voltage obtained by adding a threshold voltage of the light emitting element 124 to a voltage VSS of a common voltage line PVSS.

When the initialization period ends, the writing and threshold compensation period is entered. The period between time t2 and time t3 is the writing and threshold compensation period (Vsig/OC [N]) of a pixel circuit 118*a*. In a writing and threshold compensation period, writing of gradation data and threshold compensation of the second transistor TR2 are performed.

Figure 6:
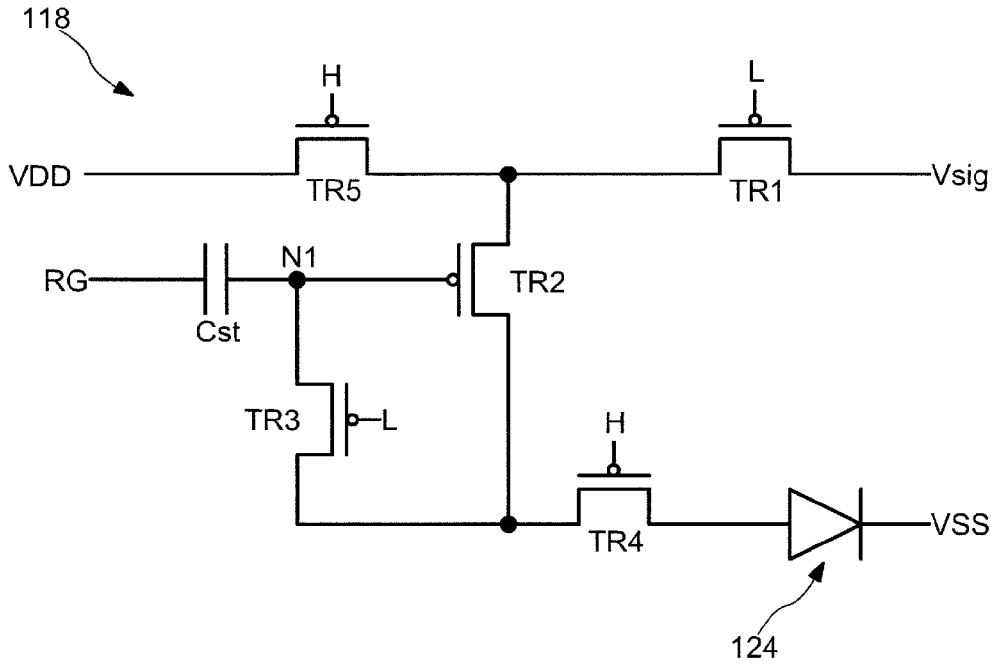
FIG. 6 is a circuit diagram for explaining an operation in a writing and threshold compensation period of a display device related to one embodiment of the present invention.

FIG. 6 is a circuit diagram for explaining an operation of a writing and threshold compensation period in the display device 100 related to the present embodiment.

At the time t2, a voltage of the second terminal of the storage capacitor Cst is changed by changing an initialization control signal line RG to a second voltage V2 which is lower than the first voltage V1 so that the third transistor TR3 is turned OFF. In the present embodiment, since the third transistor TR3 is a P channel transistor, a low level voltage is applied to the second terminal of the storage capacitor Cst and the third transistor TR3 is turned OFF.

Furthermore, at the time t2, a signal for turning the first transistor TR1 and third transistor TR3 to ON is supplied to a scanning signal line SG. In the present embodiment, since the first transistor TR1 and third transistor TR3 are P channel transistors, the voltage of a scanning signal line is set to a low level and both transistors are turned ON.

Here, a control terminal and second terminal of the second transistor TR2 conduct electricity when the third transistor TR3 is turned ON, and changes to a diode connected state. Gradation data is supplied to a video signal line Vsig in the state. In this way, gradation data and threshold data of the second transistor TR2 are written to the first node N1.

Here, gradation data and threshold data of the second transistor TR2 are explained. When Vsig [N] is output to a video signal line in writing and threshold compensation of a pixel circuit 118*a*, a voltage Vsig [N]+Vth2 obtained by adding the threshold Vth2 of the second transistor TR2 to Visg [N] is output in the second terminal side (that is, third transistor TR3 side) of the second transistor TR2. That is, a voltage Vsig [N]+Vth2 is output to the first node N1.

When a writing and threshold compensation period ends, a light emitting period is entered. After the time t3 is a light emitting period (Emission [N]) of a pixel circuit 118*a*.

Figure 7:
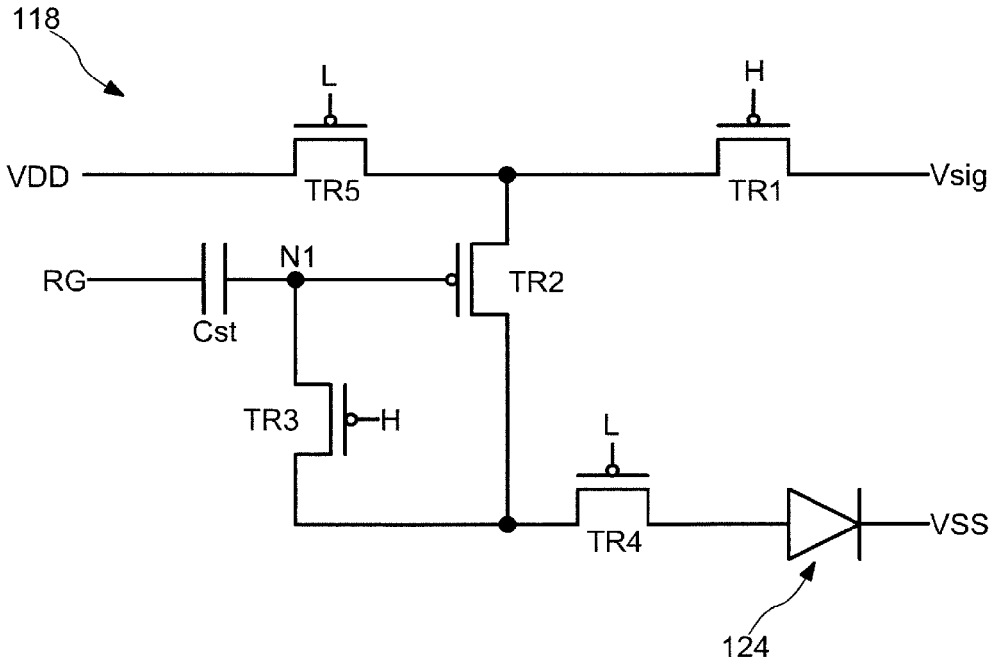
FIG. 7 is a circuit diagram for explaining an operation in a light emitting period of a display device related to one embodiment of the present invention.

FIG. 7 is a circuit diagram for explaining an operation of a light emitting period of a display device related to the present embodiment. At the time t3, a signal for turning the first transistor TR1 and third transistor TR3 OFF is supplied to a scanning signal line SG. In the present embodiment, since the first transistor TR1 and third transistor TR3 are P channel transistors, the voltage of the scanning signal line is set to a high level and the first transistor TR1 and third transistor TR3 are turned OFF.

In this state, the fourth transistor TR4 and fifth transistor TR5 are turned ON. In the present embodiment, since the fourth transistor TR4 and fifth transistor TR5 are P channel transistors, the voltage of a light emitting control signal line EG is set to a low level and the fourth transistor TR4 and fifth transistor TR5 are turned ON. In this way, a current flows to the light emitting element 124 and it is possible to emit light.

In a light emitting period, a voltage of a control terminal of the second transistor TR2 which functions as a drive transistor is maintained at Vsig [N]+Vth2. When this voltage is applied to the control terminal of the second transistor TR2, it is possible to generate a drive current with a dependency on a threshold of the second transistor TR2 removed in order to make a current value in a saturation region of the second transistor TR2 proportional to the square of (Vsig [N]−VDD). In this way, display defects due to a threshold variation of the second transistor TR2 included in each pixel circuit can be removed.

A structure and driving method of a display device 100 related to the present embodiment was explained above. In the display device related to the present embodiment, it is possible to set to the number of transistors included in one pixel to five, and reduce the number more than the conventional technology. Furthermore, by using the driving method of the display device related to the present embodiment, threshold compensation of a second transistor TR2 which functions as a drive transistor is possible. Therefore, further high definition of a display device is possible.

Second Embodiment

The structure and driving method of a display device 200 related to the present embodiment is explained using the drawings. Furthermore, since a structure of the display device 200 is approximately the same as the display device 100 related to the first embodiment, a detailed explanation is omitted.

[Circuit Structure]

Figure 8:
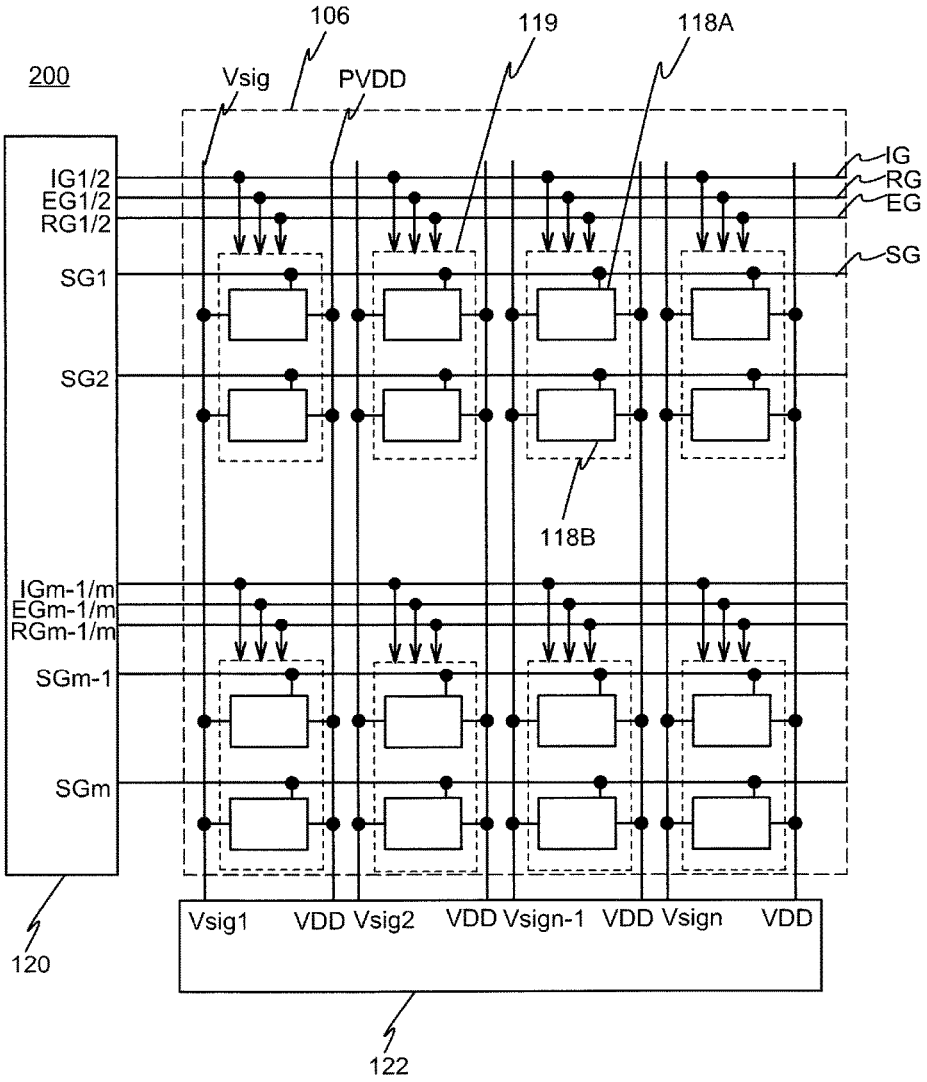
FIG. 8 is a circuit diagram for explaining a circuit structure of a display device related to one embodiment of the present invention.

FIG. 8 is a circuit diagram for explaining a circuit structure of a display device 200 related to the present embodiment.

The display device 200 related to the present embodiment includes a plurality of pixel circuit groups 119, a scanning line drive circuit 120 and a signal line drive circuit 122. The display device 200 further includes a plurality of first scanning signal lines IG, a plurality of second scanning signal lines SG, a plurality of initialization control signal lines RG, a plurality of light emitting control signal lines EG, a plurality of video signal lines Vsig and a plurality of power supply voltage lines PVDD.

A scanning line drive circuit 120 outputs signals IG1/2~IGm-1/*m* to each of the plurality of first scanning signal lines IG respectively, signals SG1~SGm to each of the plurality of second scanning signal lines SG respectively, signals RG1/2~RGm-1 to each of the plurality of initialization control signal lines RG respectively, and signals EG1/2~EGm-1/*m* to each of the plurality of light emitting control signal lines EG respectively.

The signal drive circuit 122 outputs a video signals Vsig1~Vsign to each of the plurality of video signal lines Vsig respectively. In addition, the signal drive circuit 122 may also output a power supply voltage VDD to the plurality of power supply voltage lines PVDD as shown in the diagrams. The plurality of video signal lines Vsig and the plurality of power supply voltage lines PVDD are arranged intersecting the plurality of scanning signal lines SG, the plurality of initialization control signal lines RG and plurality of light emitting control signal lines EG.

Each of the plurality of pixel circuit groups 119 includes a plurality of pixel circuits. In the present embodiment, each of the plurality of pixel circuit groups 119 includes two pixel circuits (first pixel circuit 118*a* and second pixel circuit 118*b*). In addition, each of the plurality of pixel circuit groups 119 is arranged in a matrix shape in a display region 106 of the display device 200. In addition, each of the plurality of pixel circuit groups 119 is connected to any one of the plurality of first scanning signal lines IG and any one of the plurality of video signal lines Vsig. Furthermore, each of the plurality of pixel circuit groups 119 is connected to any one of the plurality of initialization control signal lines RG, plurality of light emitting control signal lines EG and plurality of power supply voltage lines PVDD. While the arrangement of the plurality of pixel circuit groups 119 is not limited to a matrix shape, in the present embodiment the plurality of pixel circuit groups 119 is arranged in a matrix shape of m/2 rows and n columns (m and n are integers and m is an even number).

Next, a circuit structure of each of the plurality of pixel circuit groups 119 in the display device 200 related to the present embodiment is explained in detail.

Furthermore, each of the pixel circuit groups 119 includes a plurality of transistors. In the explanation herein, the gate of a transistor is sometimes referred to as a control terminal. In addition, for the purposes of convenience, one of either a source terminal or drain terminal of a transistor is sometimes referred to as a first terminal and the other a second terminal. That is, a first terminal of a transistor may sometimes function as a source terminal and may sometimes function as a drain terminal depending on the conditions of a voltage applied to each terminal of the transistor. The same is also the case with respect to the second terminal.

Figure 9:
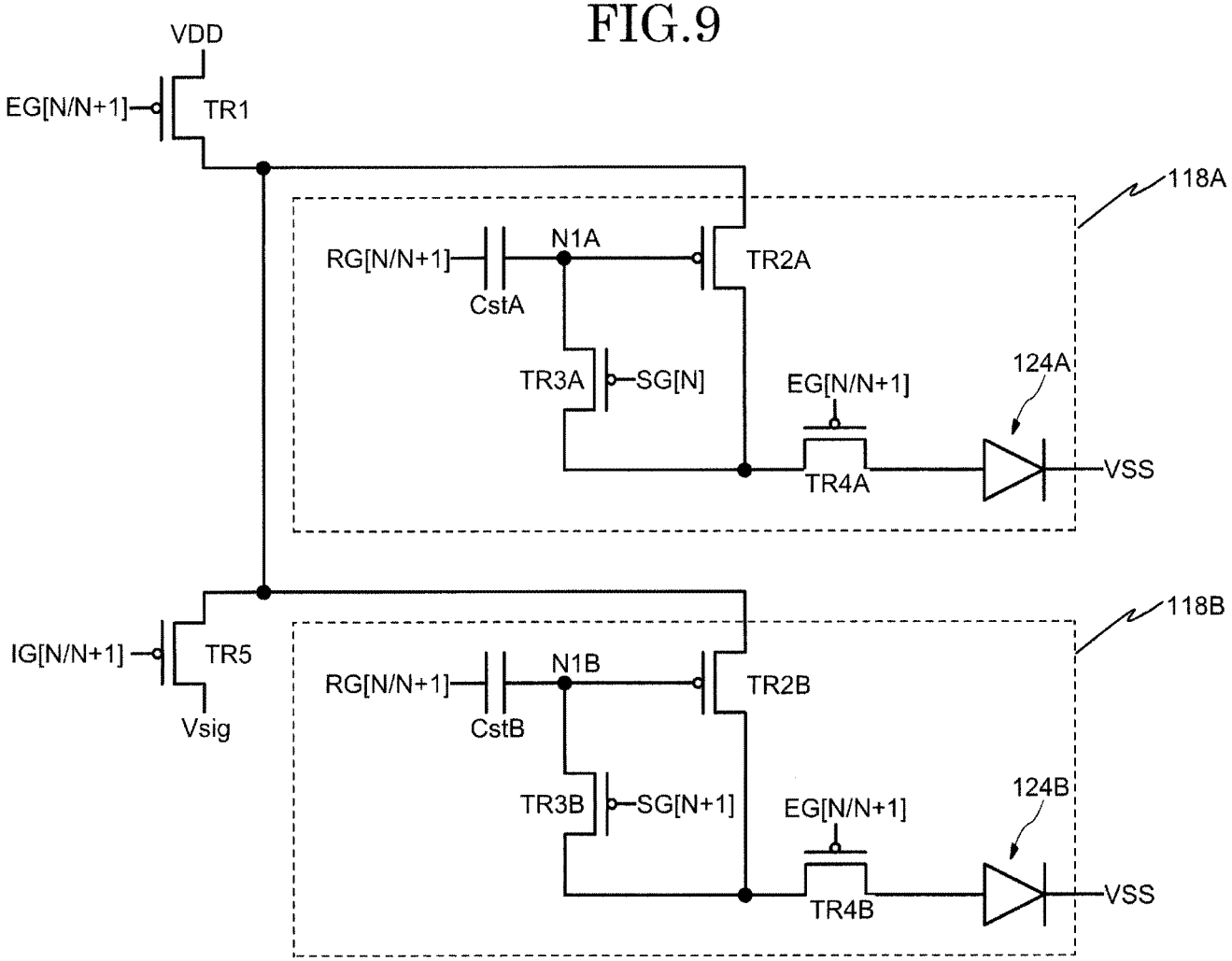
FIG. 9 is a diagram for explaining a circuit structure of each of a plurality of pixel circuit groups included in a display device related to one embodiment of the present invention.

FIG. 9 is a diagram for explaining a circuit structure of each of the plurality of pixel circuit groups 119 included in the display device 200 related to the present embodiment. Each of the plurality of pixel circuits 119 included in the display device 200 related to the present embodiment includes a first transistor TR1, fifth transistor TR5 and plurality of pixel circuits (first pixel circuit 118A and second pixel circuit 118B).

A control terminal of the first transistor TR1 is connected to a light emitting control signal line EG. In addition, a first terminal is connected to a power supply voltage line PVDD, and a second terminal is connected to a first pixel circuit 118A and second pixel circuit 118B included in a pixel circuit group 119.

A control terminal of the fifth transistor TR5 is connected to a first scanning signal line G. In addition, a first terminal is connected to a video signal line Vsig, and a second terminal is connected to a first pixel circuit 118A and second pixel circuit 118B included in a pixel circuit group 119.

A circuit structure of each of the plurality of pixel circuits (first pixel circuit 118A and second pixel circuit 118B) included in each of the plurality of pixel circuit groups 119 is explained. The plurality of pixel circuits (first pixel circuit 118A and second pixel circuit 118B) included in each of the plurality of pixel circuit groups 119 includes second to fourth transistors TR2~TR4, a storage capacitor Cst and a light emitting element 124. In the present embodiment, one pixel circuit group 119 includes two pixel circuits, first pixel circuit 118A and second pixel circuit 118B. Since the circuit structure of both is the same, a circuit structure of the first pixel circuit 118A is explained in particular herein while an explanation of a circuit structure of the second pixel circuit 118B is omitted.

A control terminal of the second transistor TR2A is connected to a first node N1A. A first terminal of the second transistor TR2A is connected to a second terminal of the first transistor TR1 and a second terminal of the fifth transistor TR5A. The second transistor TR2A functions as a drive transistor and supplies a current to the light emitting element 124A depending on a voltage applied to a control terminal. In addition, when driving the display device 200, the second transistor TR2A drives in a saturated state.

A control terminal of the third transistor TR3A is connected to a second scanning signal line SG. In addition, a first terminal of the third transistor TR3A is connected to a first node N1A. A second terminal of the third transistor TR3A is connected to the second terminal of the second transistor TR2A. When the third transistor TR3A is turned ON according to a voltage of the second scanning signal line SG, a control terminal and second terminal conduct electricity and the second transistor TR2A changes to a diode connected state.

A control terminal of the fourth transistor TR4A is connected to a light emitting control signal line EG. In addition, a first terminal of the fourth transistor TR4A is connected to the second terminal of the second transistor TR2A and the second terminal of the third transistor TR3A. By controlling a voltage of the light emitting control signal line EG and turning both the first transistor TR1 and fourth transistor TR4A to ON, it is possible to supply a current to a light emitting element 124A and set the light emitting element 124A to a light emitting state.

A first terminal of the storage capacitor CstA is connected to a first node N1A. A second terminal of the storage capacitor CstA is connected to an initialization control signal line RG.

An anode of the light emitting element 124A is connected to the second terminal of the fourth transistor TR4A. A cathode of the light emitting element 124A is connected to a common voltage line PVSS. The light emitting element 124A is a current driven type element which emits light at the luminosity according to a supplied current. In the present embodiment, the light emitting element 124A is an organic light emitting diode.

Furthermore, in the present embodiment, the first to fifth transistors TR1, TR2A~TR4A, TR5 are P channel transistors. However, the present invention is not limited to this, and any one or all of the first to fifth transistors TR1, TR2A~TR4A, TR5 may be N channel transistors. That is, first to sixth transistors TR1, TR2A~TR5A, TR6 may be P channel transistors having the same polarity. Furthermore, since the relationship between a source and drain is interchanged in the case where all of the transistors are N channel transistors, the connection relationship of a circuit may be appropriately changed.

The structure of a pixel circuit 118 included in the display device 200 related to the present embodiment was explained above. In the present embodiment, a circuit structure is adopted including four transistors and one capacitor per pixel. In the conventional technology, at least six transistors were necessary with respect to one pixel in order to compensate a threshold voltage of a drive transistor.

According to a driving method of the display device 200 described in detail herein, it is possible to perform threshold compensation in the display device 200 having the structure described above. That is, since it is possible to reduce the number of transistors included in one pixel using the display device 200 compared to a display device of the conventional technology, further high definition of the display device 200 is possible.

[Driving Method]

A driving method of the display device 200 related to the present embodiment is explained using the drawings.

Figure 10:
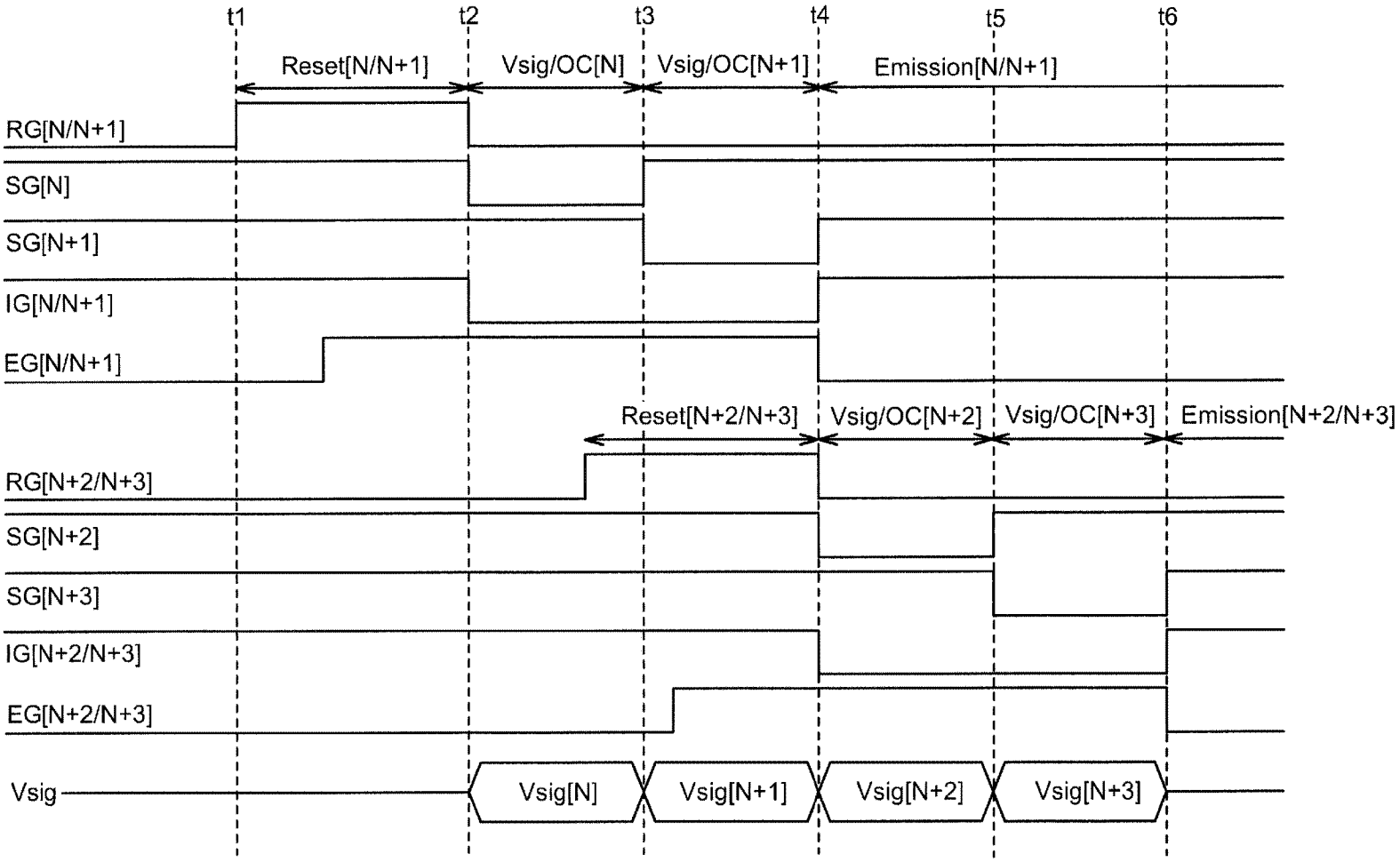
FIG. 10 is a timing chart for explaining a driving method of a display device related to one embodiment of the present invention.

FIG. 10 is a timing chart for explaining a driving method of the display device 200 related to the present embodiment. In FIG. 10, among the pixel circuit groups 119 arranged in a matrix, a timing chart is shown of a pixel circuit group 119 (sometimes shown as pixel circuit group 119*a* herein) including a pixel circuit 118A arranged on an Nth row and a pixel circuit 118B arranged on an N+1 row, and a pixel circuit group 119 (sometimes shown as pixel circuit group 119*b* herein) including a pixel circuit 118A arranged on an N+2 row and a pixel circuit 118B arranged on an N+3 row.

The display device 200 related to the present embodiment is driven in one frame including three periods, an initialization period, a writing and threshold compensation period, and a light emitting period.

Figure 11:
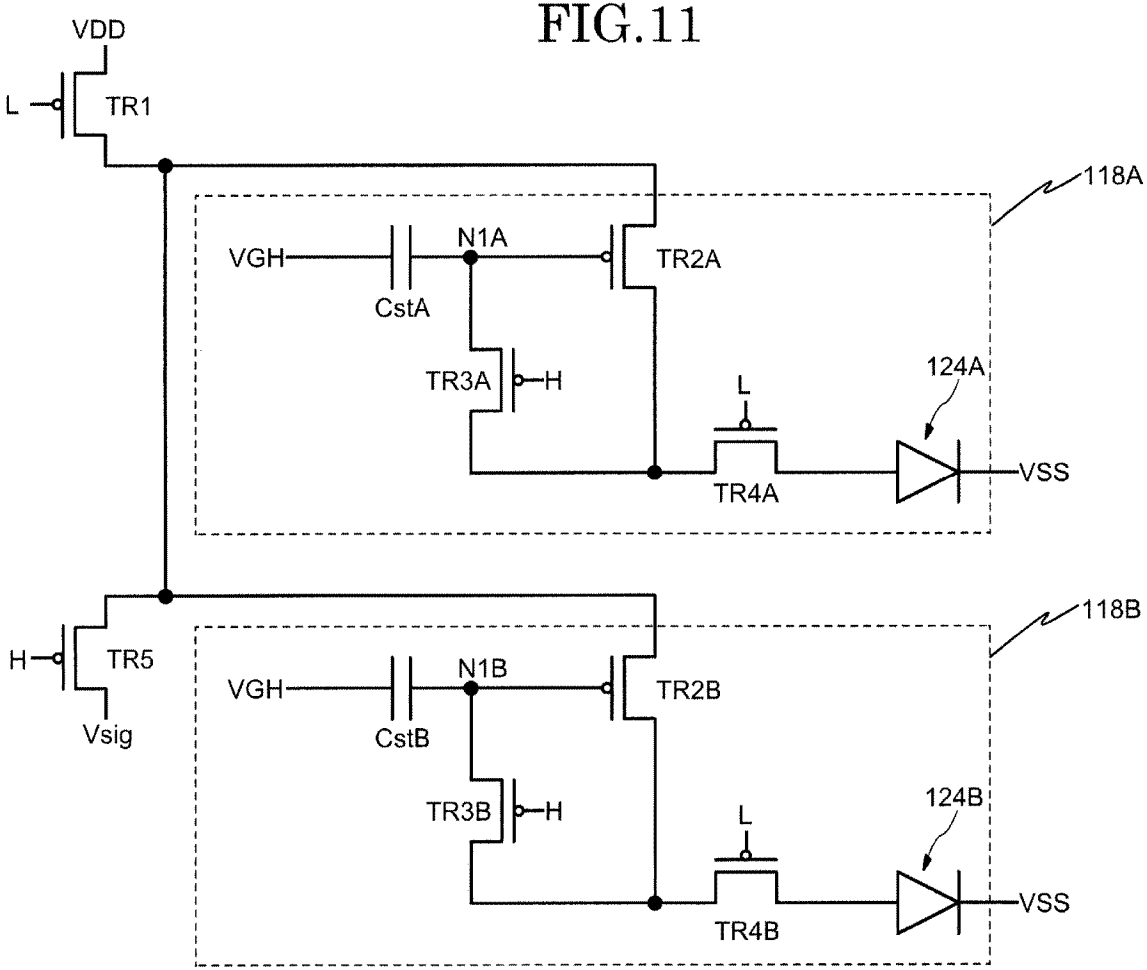
FIG. 11 is a circuit diagram for explaining an operation in an initialization period of a display device related to one embodiment of the present invention.

First, driving in an initialization period is explained. In an initialization period, a first pixel circuit 118A and second pixel circuit 118B included in the same pixel circuit group 119 are driven in the same manner. As a result, a driving operation of the first pixel circuit 118A is explained and an explanation of a circuit structure of the second pixel circuit 118B is omitted. The period between time t1 and time t2 is the initialization period (Reset [N/N+1]) of a pixel circuit group 119 and the first pixel circuit 118A and second pixel circuit 118B are initialized at the same time. FIG. 11 is a circuit diagram for explaining the operation of an initialization period of the display device 200 related to the present embodiment. Immediately before an initialization period, since a charge corresponding to gradation data of a previous frame is accumulated in the first node N1A, a certain voltage is initialized by discharging these charges in the initialization period before writing gradation data of the subsequent frame.

Before entering an initialization period, a signal for turning the third transistor TR3A to OFF is supplied in advance to the control terminal of the third transistor TR3A. In the present embodiment, since the third transistor TR3A is a P channel transistor, a high level (H) voltage is applied to the control terminal of the third transistor TR3A and turned OFF in advance.

In addition, before entering an initialization period, the first transistor TR1 and fourth transistor TR4A are turned ON in advance. In the present embodiment, since the first transistor TR1 and fourth transistor TR4A are P channel transistors, a low level (L) voltage is applied to the control terminal of the first transistor TR1 and fourth transistor TR4AS via the light emitting control signal line EG and turned ON in advance.

When entering the initialization period at time t1 in this state, a voltage of the second terminal of the storage capacitor CstA is changed by changing an initialization control signal line RG to a first voltage V1 so that the third transistor TR3A is turned ON. In the present embodiment, since the third transistor TR3A is a P channel transistor, a positive voltage VGH is applied to the second terminal of the storage capacitor CstA via the initialization control signal line RG and the third transistor TR3A is turned ON.

In order to turn the third transistor TR3A to ON, it is necessary to supply a voltage VG3+Vth3A obtained by adding a threshold voltage Vth3 of each third transistor TR3A to a high level voltage VG3 applied to a control terminal of the third transistor TR3A to a first terminal (first node N1A) of the third transistor TR3A. In this way, the third transistor TR3A is turned ON since the voltage of the control terminal of the third transistor TR3A drops lower than Vth3 when the first terminal of the third transistor TR3A is set as a reference.

In this way, it is possible to discharge a charge accumulated in the first node N1A in a previous frame via the third transistor TR3A. At this time, the second transistor TR2A is maintained in an OFF state.

A charge accumulated in the first node N1A in a previous frame is discharged by the operation in the initialization period. At this time, this charge is discharged to a common voltage line PVSS via the light emitting element 124A. A video signal written in a previous frame from the storage capacitor CstA is initialized by this discharge. Specifically, the voltage of the first node N1A is a voltage which does not include a video signal of a previous frame, and converges to a voltage obtained by adding a threshold voltage of the light emitting element 124A to a voltage VSS of a common voltage line PVSS.

When the initialization period ends, the writing and threshold compensation period is entered. This process is individually performed with respect to the first pixel circuit 118A and second pixel circuit 118B included in each pixel circuit group 119. The period between time t2 and time t3 is the writing and threshold compensation period (Vsig/OC [N]) of a first pixel circuit 118A, and the period between time t3 and time t4 is the writing and threshold compensation period (Vsig/OC [N+1]) of second pixel circuit 118B. In a writing and threshold compensation period, writing of gradation data is performed to each of the pixel circuits (first pixel circuit 118A and second pixel circuit 118B) and threshold compensation of the second transistors TR2A and TR2B which function as a drive transistor is performed.

Figure 12:
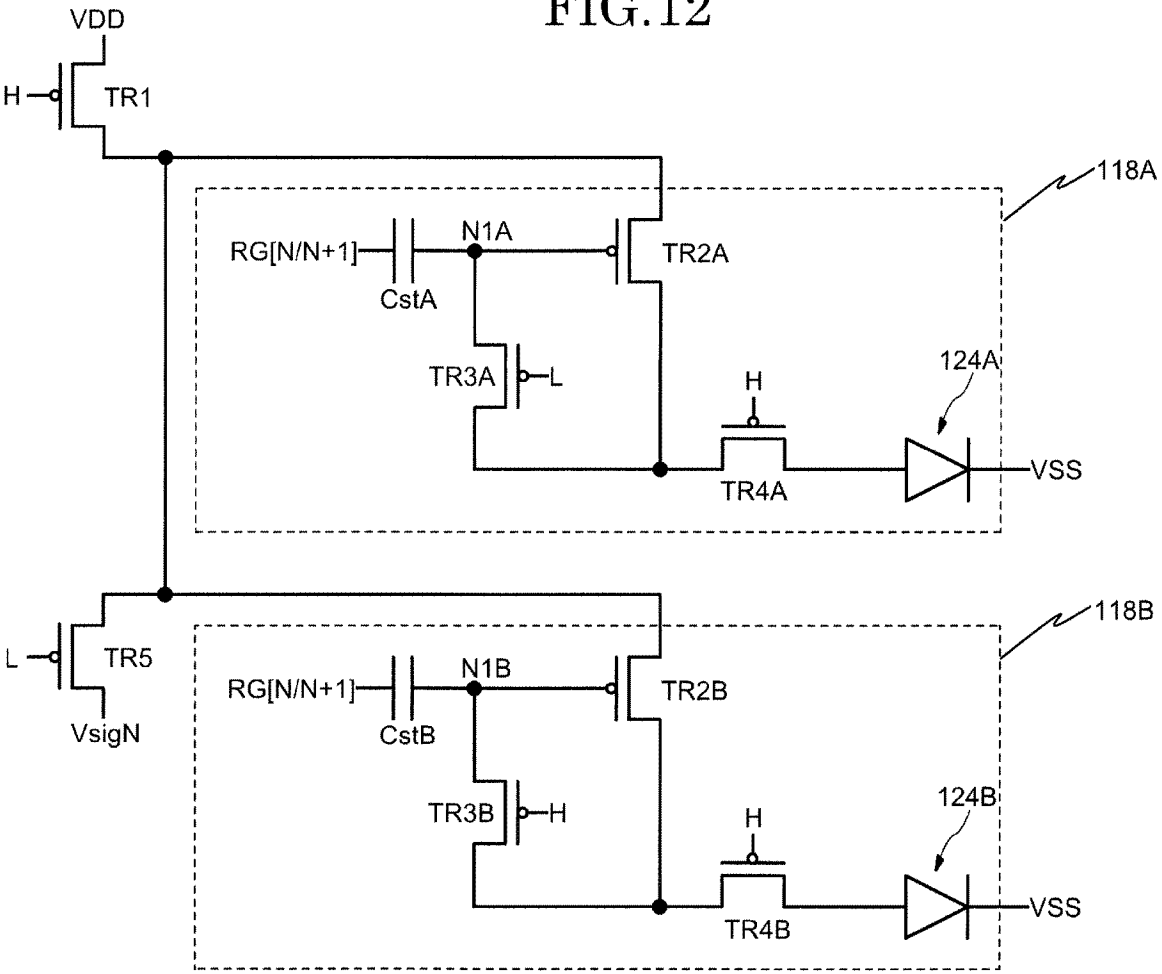
FIG. 12 is a circuit diagram for explaining an operation in a writing and threshold compensation period of a display device related to one embodiment of the present invention.
Figure 13:
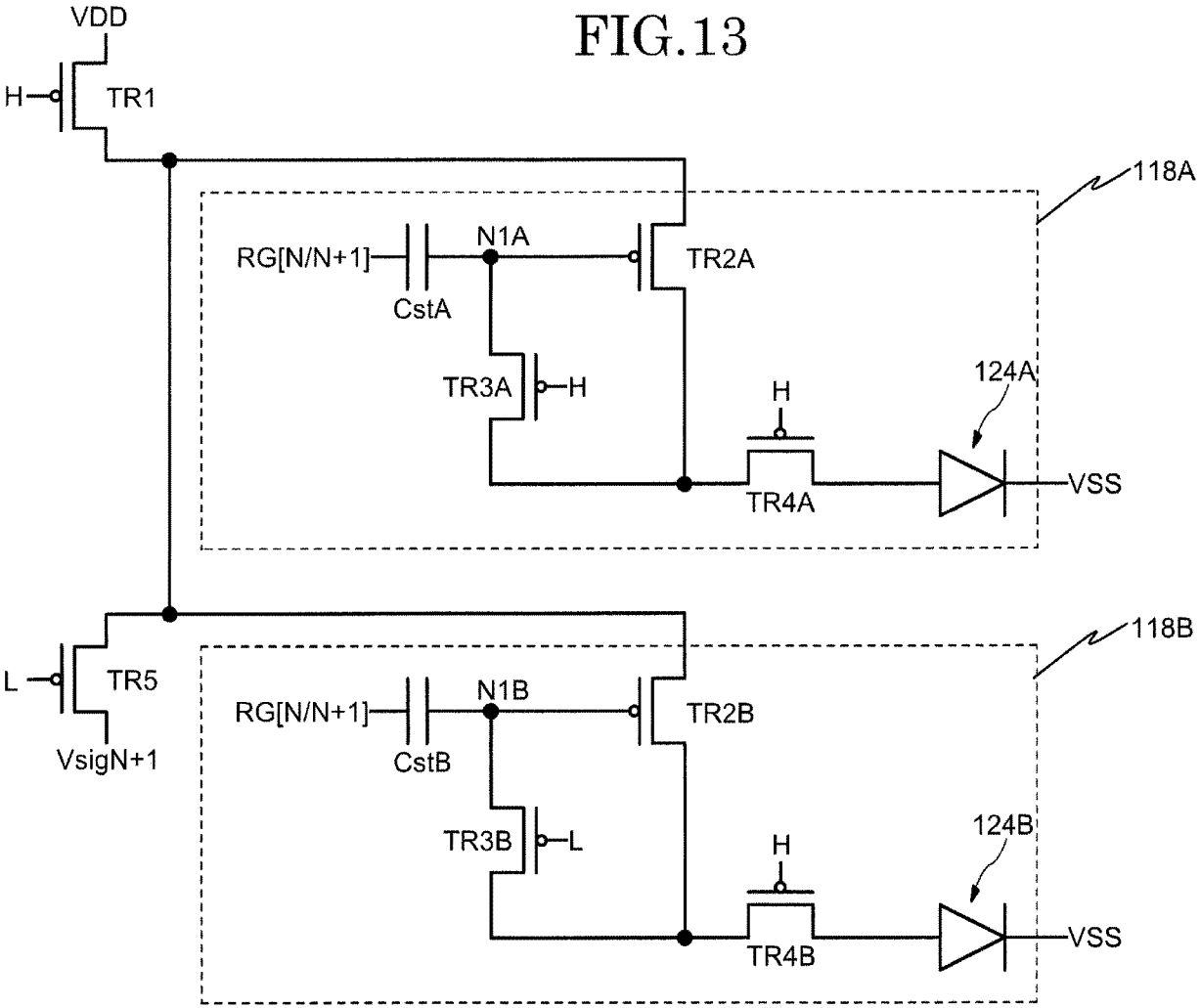
FIG. 13 is a circuit diagram for explaining an operation in a writing and threshold compensation period of a display device related to one embodiment of the present invention.

FIG. 12 and FIG. 13 are circuit diagrams for explaining an operation of a writing and threshold compensation period in the display device 200 related to the present embodiment At the time t2, a voltage of the second terminal of the storage capacitors CstA and CstB is changed by changing an initialization control signal line RG to a second voltage V2 which is lower than the first voltage V1 so that the third transistors TR3A and TR3B are turned OFF. In the present embodiment, since the third transistors TR3A and TR3B are P channel transistors, a low level voltage is applied to the second terminal of the storage capacitors CstA and CstB and the third transistors TR3A and TR3B are turned OFF.

Furthermore, at the time t2, a signal for turning the fifth transistor TR5 to ON is supplied to a first scanning signal line IG. In the present embodiment, since the fifth transistor TR5 is a P channel transistor, the voltage of a first scanning signal line IG is set to a low level and the fifth transistor is turned ON.

In this state, gradation data is supplied in sequence to a video signal line Vsig by turning ON in sequence the third transistors TR3A and TR3B of the plurality of pixel circuits (first pixel circuit 118A and second pixel circuit 118B). In this way, gradation data and threshold data of the second transistor TR2A are written is written to a first node N1A. Next, gradation data and threshold data of the second transistor TR2B are written is written to a first node N1B.

In the example shown in FIG. 10, at the period between time t2 and time t3, gradation data and threshold data of the second transistor TR2A are written to the first pixel circuit 118A by setting the second scanning signal line SG [N] to a low level and turning the third transistor TR3A to ON. Next, at the period between time t3 and time t4, a second scanning signal line SG [N] is set to a high level, the third transistor TR3A is turned OFF, a second scanning signal line SG [N+1] is set to a low level, and the third transistor TR3B is turned ON. In this way, gradation data and threshold data of the second transistor TR2B are written to the second pixel electrode 118B.

Here, gradation data and threshold data of the second transistor TR2A are explained. When Vsig [N] is output to a video signal line in the writing and threshold compensation of a first pixel circuit 118A, a voltage Vsig [N]+Vth2A obtained by adding the threshold Vth2A of the second transistor TR2A to Visg [N] is output in the second terminal side of the second transistor TR2A. That is, a voltage Vsig [N]+Vth2A is output to the first node N1A.

On the other hand, the period between time t2 and time t4 also include an initialization period (Reset [N+2/N+3]) of a pixel circuit group 119*b*. In the present embodiment, the initialization period (Reset [N+2/N+3]) starts during the period between time t2 and time t3, and finishes at time t4. However, the timing of the initialization period (Reset [N+2/N+3]) is not limited to this. Since it is sufficient that the initialization period (Reset [N+2/N+3]) secures a sufficient time for discharging a charge accumulated in the first node N1, for example, the initialization period (Reset [N+2/N+3]) may start within the period between time t3 and time t4 and finish at time t4. That is, the initialization period (Reset [N+2/N+3]) at least may overlap a writing and threshold compensation period (Vsig/OC [N+1]) of the second pixel circuit 118B of the pixel circuit group 119*a*.

By this driving method, it is possible to drive a pixel circuit 118 on each row in sequence, and it is easy to sufficiently secure an initialization period and writing and threshold compensation period on each row.

When a writing and threshold compensation period ends, a light emitting period is entered. After the time t4 is a light emitting period of a pixel circuit group 119*a*, and the light emitting elements 124A and 124B emit light at the same time. In a light emitting period, since the first pixel circuit 118A and second pixel circuit 118B are included in the same pixel circuit group 119 are driven in the same manner, an operation of the first pixel circuit 118A is explained in particular and an explanation of the operation of the second pixel circuit 119B is omitted.

Figure 14:
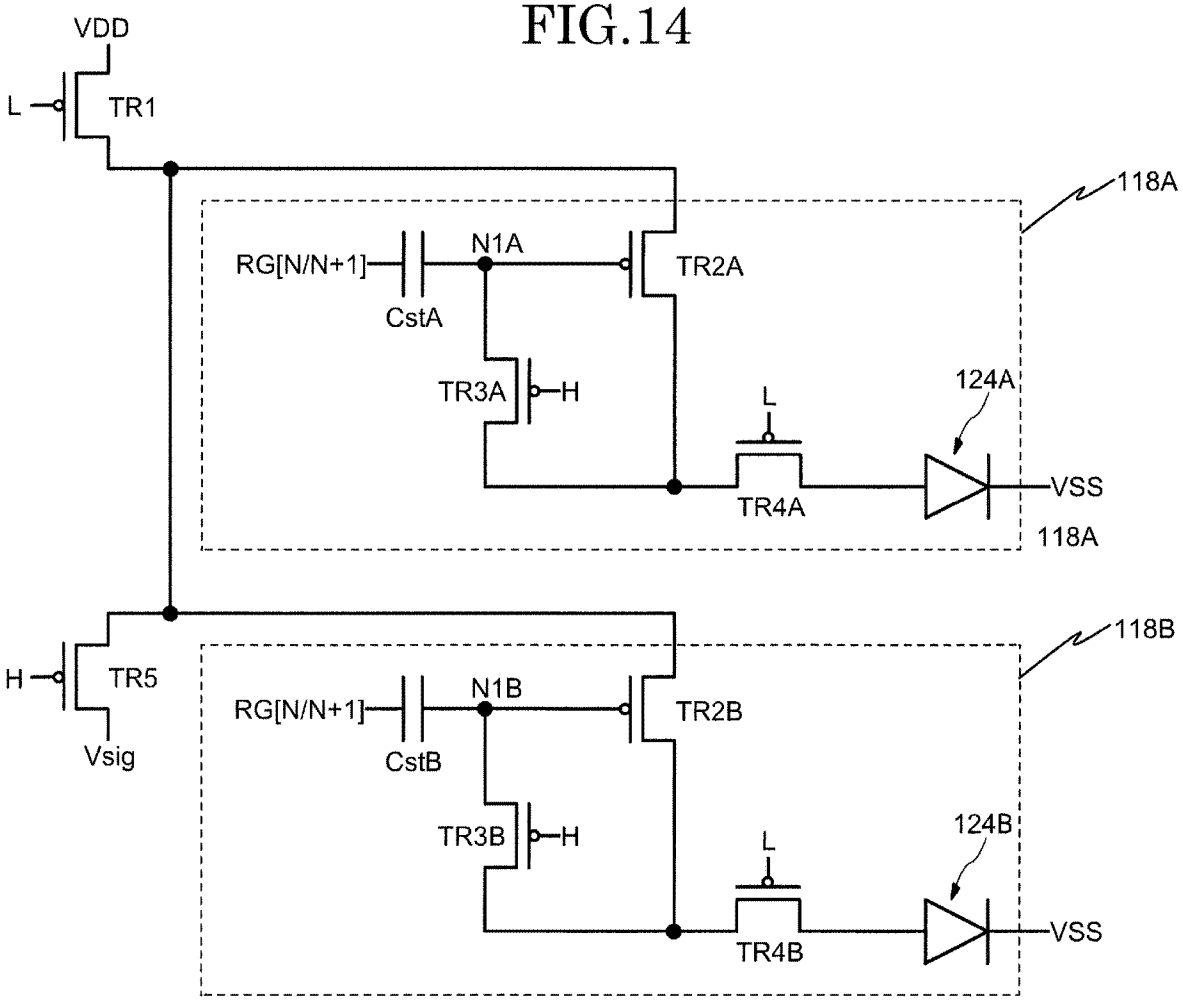
FIG. 14 is a circuit diagram for explaining an operation in a light emitting period of a display device related to one embodiment of the present invention.

FIG. 14 is a circuit diagram for explaining an operation of a light emitting period of a display device 200 related to the present embodiment. A signal for turning the third transistor TR3A and fifth transistor TR5 OFF is supplied at the time t4. In the present embodiment, since the third transistor TR3A and fifth transistor TR5 are P channel transistors, the voltage of the second scanning signal line SG and first scanning signal line IG is set to a high level and the third transistor TR3A and fifth transistor TR5 are turned OFF.

In this state, the first transistor TR1 and fourth transistor TR4A are turned ON. In the present embodiment, since the first transistor TR1 and fourth transistor TR4A are P channel transistors, the voltage of a light emitting control signal line EG is set to a low level and the first transistor TR1 and fourth transistor TR4A are turned ON. In this way, a current flows to the light emitting element 124A and it is possible to emit light.

In a light emitting period, a voltage of a control terminal of the second transistor TR2A is maintained at Vsig [N]+Vth2A. When this voltage is applied to the control terminal of the second transistor TR2A, it is possible to generate a drive current with a dependency on a threshold of the second transistor TR2A removed in order to make a current value in a saturation region of the second transistor TR2A proportional to the square of (Vsig [N]−VDD). In this way, display defects due to a threshold variation of the second transistor TR2A included in each pixel circuit can be removed.

On the other hand, at the time t4, a writing and threshold compensation period (Vsig/OC [N+2]) of a pixel circuit group 119*b* starts. That is, a writing and threshold compensation period (Vsig/OC [N+2] and Vsig/OC [N+3]) of a pixel circuit group 119*b* overlaps a light emitting period (Emission [N/N+1]) of a pixel circuit group 119*a*. A writing and threshold compensation period of a pixel circuit group 119*b* becomes (Vsig/OC [N+3]) at time 5 and then becomes a light emitting period of a pixel circuit group 119*b* at time t6.

By using this driving method, it is possible to drive pixel circuits (first pixel circuit 118A and second pixel circuit 118B) on each row in sequence, and easily secure a sufficient initialization period, writing and threshold compensation period and light emitting period on each row.

A structure and driving method of a display device 200 related to the present embodiment was explained above. In the display device related to the present embodiment, it is possible to set to the number of transistors included in one pixel to four, and reduce the number more than the conventional technology. Furthermore, by using the driving method of the display device related to the present embodiment, threshold compensation of second transistors TR2A and TR2B which function as drive transistors is possible. Therefore, further high definition of a display device is possible.

In addition, an example was explained in the present embodiment in which one pixel circuit group 119 includes two pixel circuits 118. However, the present invention is not limited to this example. It is easy to expand this example to a case where one pixel circuit group 119 includes three or more pixel circuits 118.

In the scope of the concept of the present invention, a person ordinarily skilled in the art could conceive of various modification or improvement examples and such modification or improvement examples are understood to belong to the scope of the present invention. For example, with respect to each of the embodiments described above, a person ordinarily skilled in the art could appropriately perform an addition or removal of structural components or design modification or an addition of processes or an omission or change in conditions which are included in the scope of the present invention as long as they do not depart from the subject matter of the present invention.

What is claimed is:

1. A display device comprising:

a plurality of first scanning signal lines;

a plurality of second scanning signal lines;

a plurality of initialization control signal lines;

a plurality of light emitting control signal lines;

a plurality of video signal lines arranged intersecting the plurality of first scanning signal lines, the plurality of second scanning signal lines, the plurality of initialization control signal lines, and the plurality of light emitting control signal lines; and a plurality of pixel circuit groups each connected to one of the first scanning signal lines, one of the second scanning signal lines, one of the initialization control signal lines, one of the light emitting control signal lines, and one of the video signal lines;

wherein each of the plurality of pixel circuit groups includes a first pixel circuit;

a second pixel circuit;

a first transistor including a control terminal connected to the light emitting control signal line, a first terminal connected to a power supply voltage line, and a second terminal; and a fifth transistor including a control terminal connected to the first scanning signal line, a first terminal connected to the video signal line, and a second terminal;

the first pixel circuit includes:

a second transistor including a control terminal connected to a first node, a first terminal connected to the second terminal of the first transistor and the second terminal of the fifth transistor, and a second terminal;

a third transistor including a first terminal connected to the first node, a second terminal connected to the second terminal of the second transistor, and a control terminal connected to the second scanning signal line;

a fourth transistor including a first terminal connected to the second terminal of the second transistor, a second terminal, and a control terminal connected to the light emitting control signal line;

a storage capacitor including a first terminal connected to the first node, and a second terminal connected to the initialization control signal line; and a light emitting element connected to the second terminal of the fourth transistor, and the second pixel circuit includes:

another second transistor including a control terminal connected to another first node, a first terminal connected to the second terminal of the first transistor and the second terminal of the fifth transistor, and a second terminal;

another third transistor including a first terminal connected to the another first node, a second terminal connected to the second terminal of the another second transistor, and a control terminal connected to the second scanning signal line;

another fourth transistor including a first terminal connected to the second terminal of the another second transistor, a second terminal, and a control terminal connected to the light emitting control signal line;

another storage capacitor including a first terminal connected to the another first node, and a second terminal connected to the initialization control signal line; and another light emitting element connected to the second terminal of the another fourth transistor.

2. The display device according to claim 1, further comprising:

a drive circuit outputting a signal to the first scanning signal line, the second scanning signal line, the initialization control signal line, the light emitting control signal line, and the video signal line;

wherein the drive circuit supplies a signal to the control terminal of the third transistor to turn the third transistor OFF in an initialization period; and the drive circuit changes a voltage of the second terminal of the storage capacitor by changing the initialization control signal line to a first voltage so that the third transistor changes to ON in the initialization period.

3. The display device according to claim 2, wherein the drive circuit changes a voltage of the second terminal of the storage capacitor by changing the initialization control signal line to a second voltage lower than the first voltage in a writing and threshold compensation period after the initialization period, the drive circuit turns the third transistor to ON in sequence and supplies gradation data in sequence to the video signal line in a state where a signal for turning the fifth transistor to ON is supplied to the first scanning signal line in the writing and threshold compensation period.

4. The display device according to claim 3, wherein the drive circuit changes the first transistor and fourth transistor to ON in light emitting period after the writing and threshold compensation period in a state where a signal for turning the third transistor and fifth transistor to OFF is supplied to the first scanning signal line, and the drive circuit supplies a current to the light emitting element to emit light from the light emitting element in the light emitting period.

5. The display device according to claim 1, wherein the first to fifth transistors are transistors having the same polarity.

6. The display device according to claim 5, wherein the first to fifth transistors are P channel transistors.

7. The display device according to claim 1, wherein a number of the first scanning lines is less than a number of the second scanning lines, a number of the initialization control signal lines is less than the number of the second scanning lines, and a number of the light emitting control signal lines is less than the number of the second scanning lines.

* * * * *